United States Patent [19]

Toy

[11] 4,311,260

[45] Jan. 19, 1982

[54] GARMENT DISPLAY RACK

[76] Inventor: Malcolm D. Toy, 310 Peebles St., Sewickley, Pa. 15143

[21] Appl. No.: 129,242

[22] Filed: Mar. 11, 1980

[51] Int. Cl.[3] ..... D06C 15/00

[52] U.S. Cl. ..... 223/63; 223/72

[58] Field of Search ..... 223/63, 72, 73, 74, 223/75, 76, 77, 66, 68

[56] References Cited

U.S. PATENT DOCUMENTS

| | | | |
|---|---|---|---|
| 144,703 | 11/1873 | Ryan | 223/63 |
| 716,199 | 12/1902 | Day | 223/72 |
| 1,365,253 | 1/1921 | Lapka et al. | 223/63 |
| 1,569,792 | 1/1926 | Smith | 223/63 |
| 1,608,352 | 11/1926 | Young | 223/63 |
| 2,034,130 | 3/1936 | Boyle | 223/63 |
| 2,279,517 | 4/1942 | Oestricher | 223/68 |
| 2,412,900 | 12/1946 | Mayer | 223/72 |
| 2,418,083 | 3/1947 | Mayer | 223/63 |
| 2,418,314 | 4/1947 | Oxley | 223/63 |
| 2,437,437 | 3/1948 | Nelson | 223/63 |
| 2,527,997 | 10/1950 | Happer | 223/63 |
| 2,604,240 | 7/1952 | Dinkel | 223/63 |
| 2,620,099 | 12/1952 | Laikauf | 223/68 |
| 2,796,206 | 6/1957 | Schwartz | 223/68 |
| 2,814,424 | 11/1957 | Wexler et al. | 223/68 |
| 3,033,429 | 5/1962 | Richterkessing | 223/68 |
| 3,084,837 | 4/1963 | Wolf | 223/68 |
| 3,113,707 | 12/1963 | Wiston | 223/72 |
| 3,356,271 | 12/1967 | Sobel | 223/66 |
| 3,407,978 | 10/1968 | Sander | 223/72 |
| 4,066,192 | 1/1978 | Wolf | 223/72 |

*Primary Examiner*—Louis Rimrodt

*Attorney, Agent, or Firm*—Stanley J. Price, Jr.; John M. Adams

[57] ABSTRACT

A pair of leg frame members are connected in side by side spaced relationship and are adapted to be inserted in the legs of a pair of trousers to display the trousers in a selected position. Each of the leg frame members includes inner and outer seam supports formed by a plurality of elongated elements that are positioned in end to end relationship. The adjacent ends of the elongated elements are pivotally connected so that the inner and outer seam supports are formed by a plurality of spaced parallel pairs of elongated elements. Thus the pairs of elongated elements for each pair of leg frame members are independently pivotal to a preselected angular position. The pair of leg frame members can then be pivoted at a plurality of pivot points along the length thereof so as to display the legs of the trousers in a plurality of imaginative arrangements. The leg frame members are self supporting or can be supported on a stand which permits a plurality of the display racks to simultaneously display a plurality of trousers and slacks in a variety of imaginative positions to enhance merchandising of the garments. To facilitate positioning of a garment on the display rack, the inner and outer seam supports are connected by adjustment devices for relative movement toward and away from each other to vary the width between the inner and outer seam supports.

13 Claims, 13 Drawing Figures

GARMENT DISPLAY RACK

BACKGROUND OF THE INVENTION

1. Field of the Invention

This invention relates to a garment display rack adapted for supporting and displaying a garment to display the garment for merchandising and more particularly to a pair of frame members formed by a plurality of pivotally connected elongated members forming inner and outer seam supports which are resiliently connected and adapted for independent pivotal movement to preselected angular positions along the length of the display rack to display the garment in an imaginative position for merchandising.

2. Description of the Prior Art

It is well known in the retail clothing business to display garments in show windows and stores in a manner that attractively and imaginatively displays the garment to promote sales of the garment. It has been the conventional practice for many years to display garments on mannequins. However, this form of displaying garments does not lend itself to generating an eye catching appeal. Mannequins in most cases are cumbersome and difficult to handle and rigid in construction so as not to permit imaginative displays that impart an action-type effect to the garment display.

Similar to mannequins, it is known to display garments on forms which are constructed to duplicate the outline of a human figure or parts of the human anatomy. U.S. Pat. No. 3,407,978 discloses an adjustable garment form that consists of wire mesh in an arrangement that duplicates the lower part of the human torso and the legs in an outline. The form is initially shaped on the wearer so that is deformed to the outline of the wearer. The mesh construction retains the shape of the wire mesh after it has been deformed. This device is more adapted to the construction and designing of garments as opposed to the display of garments for retail sales.

A flexible garment form is disclosed in U.S. Pat. No. 716,199. This device includes a flexible arrangement of a plurality of loops which are arranged in the outline of a sleeve. The form is employed for holding a sleeve in a preselected shape while making and trimming the material out of which the sleeve is constructed.

It is also well known in the art to support garments such as trousers and slacks on frames to stretch the garments to remove wrinkles and maintain well defined creases in the garment. An early example of a garment creaser or stretcher is disclosed in U.S. Pat. No. 144,703 in which a frame is constructed of non-pivotal vertically adjustable elongated members for stretching a garment to remove bagging at the knees and wrinkles and other parts caused by wear.

U.S. Pat. Nos. 1,569,792; 2,034,130; and 2,437,437 disclose pants presses or creases that are inserted in a leg of a pair of trousers to enhance the trouser crease. Each leg of the trouser receives a separate creaser that is formed by rigid elongated members that are spread apart by spring devices and the like a preselected distance apart so that when the trouser leg is positioned on the creaser the leg is stretched under tension to maintain the crease in the leg. These devices are adjustable to adapt to trousers of different sizes.

U.S. Pat. Nos. 1,569,792; 2,437,437 disclose the elongated creaser elements as being pivotal to permit collapse of the creaser for storage. However, the above devices are not suitable for displaying garments for sale because the devices do not permit the garments to be displayed in eye-catching and imaginative arrangements.

U.S. Pat. Nos. 2,412,900; 2,418,083; 3,113,707; and 4,066,192 are directed to trouser display forms that support a pair of trousers or slacks in a position that simulates their position when worn by a user. The forms are positioned in show windows and stores and support the garment so that the garments hang naturally and thereby presents an attractive display for merchandising the garment. U.S. Pat. No. 3,113,707 discloses a pair of leg elements that are supported by a frame in suspended condition. Each leg is composed of a pair of flat leg sections shaped in the outline of a human leg and having knee and thigh joints to permit bending of the display form so that the display form can be moved into a sitting position.

U.S. Pat. Nos. 2,412,900 and 2,418,083 disclose garment display forms that include an adjustable portion for supporting the waist of the garment and rigid elongated members that extend from the waist portion down to a stand to support the elongated members in a rigid vertical position. Suitable telescoping and resilient devices are provided to permit adjustments in the distance between the vertical elongated members to accommodate trousers of different size. The elongated members are also vertically adjustable.

The display form disclosed in U.S. Pat. No. 4,066,192 supports the legs of the trousers on hangers in an arrangement that enhances the crease of the trousers by maintaining the trouser legs under tension. The leg simulating members of the form are pivotally mounted on a base to permit the trouser legs to be positioned in different angular relations and thereby provide a variety of eye-catching positions for displaying the trousers on the form.

While it has been suggested by the prior art devices to support garments, such as trousers and slacks on a form for either displaying the garment for merchandising purposes or holding the trouser crease, none of the devices permit a pair of trousers or slacks to be displayed with the legs in a bent or action-type position. With the above discussed known devices the legs are maintained substantially rigid and the frames do not accommodate the displaying of trousers in an eye-catching action position which attracts attention to the trousers while simulating the trousers as they would appear when actually worn. The known devices also are limited to supporting the trousers and slacks in a position defining the creases. In this position of displaying trousers it is not possible to provide a full frontal view of the trousers.

In addition, the known devices are limited in the manner in which they are supported. Supporting a pair of trousers or slacks on a rigid stand that must be positioned on the floor does not permit variation in which one or more arrangements of trousers may be attractively displayed to generate an eye catching visual effect. Therefore, there is need for a garment display rack that supports garments, such as trousers, slacks, jeans and the like in an imaginative arrangement that permits the garment to be positioned in various angular positions along the length of the garment. The rack should be operable to be supported in other than a vertical upstanding position to achieve maximum eye catching affects that provide the merchandiser with wide flexibility in the manner in which the display rack can be arranged to display the garment.

SUMMARY OF THE INVENTION

In accordance with the present invention there is provided a garment display rack that includes a frame member for supporting The frame member includes an inner seam support and an outer seam support. Adjustment means are secured to and extend between the inner and outer seam supports for normally maintaining the inner and outer seam supports in spaced relation. The adjustment means are expandable and contractable in length between the inner and outer seam supports to permit movement of the inner and outer seam supports toward and away from each other to adjust the width of the frame member. Each of the inner and outer seam supports includes a plurality of elongated elements positioned in end to end relationship. Pivot means connect adjacent ends of the elongated members to form for the inner and outer seam supports at least a pair of the elongated elements being independently pivotal to a preselected angular position so that the frame member is pivotal at a preselected pivot point along the length thereof.

The adjacent end portions of the elongated members that form the inner and outer seam supports are positioned in overlapping relation and are pivotally connected by the pivot means. To pivot means preferably include a lock washer positioned between and abutting each of the overlapping elongated elements. A threaded member extends through the elongated members and the lock washer. On the outer surface of one of the elongated members a second washer is positioned on the threaded member and a lock nut is tightened onto the threaded member to tightly compress together the composite arrangement of the two washers and the overlapping end portions of the elongated elements. With this arrangement, the respective pivotally connected elongated elements can be articulated to selected angular positions. The angular positions are maintianed without requiring the connection to be first loosened to permit pivotal movement and then tightened to maintain the pivoted position. Thus, with the present invention, the pairs of elongated members can be independently moved so that the display rack can display a pair of trousers in an action-like position and thereby generate an attractive display of the trouser on the display rack.

The adjustment means that extend between the inner and outer seam supports includes in one embodiment spring steel members that are spaced along the length of each frame member and, therefore, in turn, are secured at one end to an elongated element of one pair of elements and at the opposite end to the other elongated element of the respective pair. Thus, each pair of elongated elements are compressible by provision of the spring steel member to move toward each other by application of an inward force upon each of the elongated elements.

The spring steel members normally maintain an outward force upon the elongated elements so that each of the pairs of elongated elements are operable to form a pair of leg frames that are spaced approximately an equal distance apart. This arrangement facilitates the insertion and removal of a pair of trousers on the display rack. By compressing the spring steel members, the width between the pair of leg frames is decreased to facilitate easy insertion of the trouser leg onto the respective leg frame member. Then once the trouser leg is positioned on the respective leg frame member, the spring steel members force the leg frame members outwardly to securely engage the trouser legs.

A further feature of the present invention includes a multi-socketed block that is supported on a floor stand or by a bracket to a display shelf or display case to, in turn, support the display rack in a selected position. The multi-socketed block includes a plurality of faces located at relative angles and arranged to receive a bar which extends from the block into engagement with a sleeve on one of the elongated elements at a selected end of a leg frame member. This arrangement permits the display rack to be positioned at various imaginative angles to bring attention to the trousers when displayed in a store or in a display window. This feature combined with the articulated nature of the leg frame members provides a number of creative positions for displaying a garment.

Further, in accordance with the present invention, the multi-socketed block is adaptable for supporting a plurality of garment display racks in a variety of angular positions to, in turn, support a number of garments such as trousers and slacks in an eye catching arrangement. The multi-socketed block is supported by a rod extending into the bottom socket of a block where the rod is secured in a suitable manner to a base. A plurality of individual bars extend outwardly from selected sockets of the block at relative angles to one another. The bars are connected at their opposite ends into sleeves that are secured to one of the elongated elements positioned at either the upper or lower end of one of the leg frame members.

The individual display racks are supported by the multi-socketed block and extend from the block at a preselected angle. In this manner, a number a trousers can be attractively displayed and with the trouser legs bent by articulating the display rack leg frame members to a desired angle.

An additional feature of the present invention includes mounting the rack on a display shelf by a clamp having a recess or socket for receiving a bar that, in turn, supports the multi-socketed block. The block, in turn, as above discussed, supports one or more display racks in various angular positions.

Accordingly, the principal object of the present invention is to provide a garment display rack that includes a frame member that is freely pivotal along the entire length thereof to permit displaying of a garment on the rack with the frame member bent in selected angular positions to generate an imaginative display for merchandising the garment on the display rack.

Another object of the present invention is to provide a garment display rack formed by a plurality of articulated elongated elements that are spring connected a preselected distance apart to provide a pair of leg frames that are compressible and expandable to a preselected width to facilitate ease of positioning and removing the garment on the display rack and to permit display of either the full front or full back of a pair of trousers.

A further object of the present invention is to provide a stand for supporting a plurality of articulated garment display racks in a plurality of angular positions to display garments in an imaginative arrangement.

These and other objects of the present invention will be more completely disclosed and described in the following specification, the accompanying drawings, and the appended claims.

DESCRIPTION OF THE PREFERRED EMBODIMENTS

Figure 1:
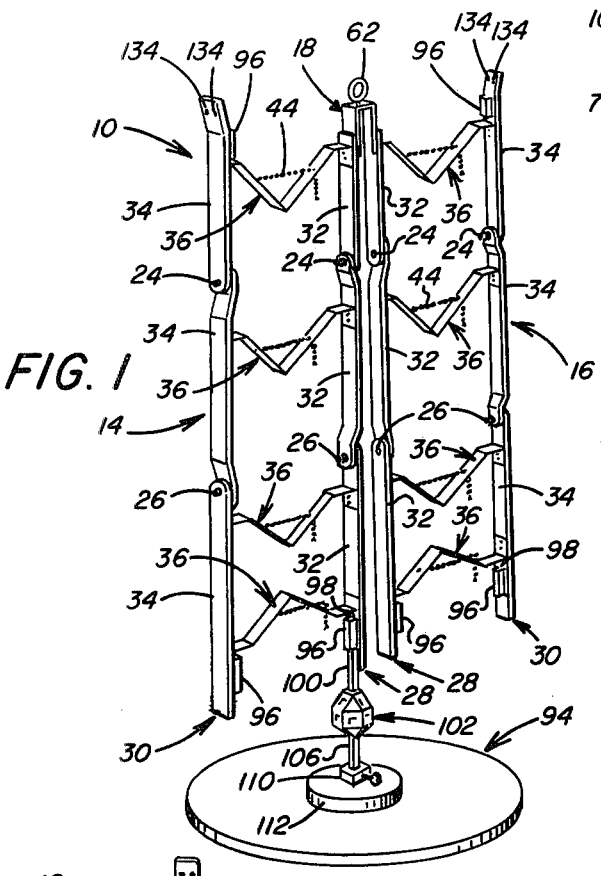
FIG. 1 is a prospective view of a garment display rack in accordance with the present invention.
Figure 2:
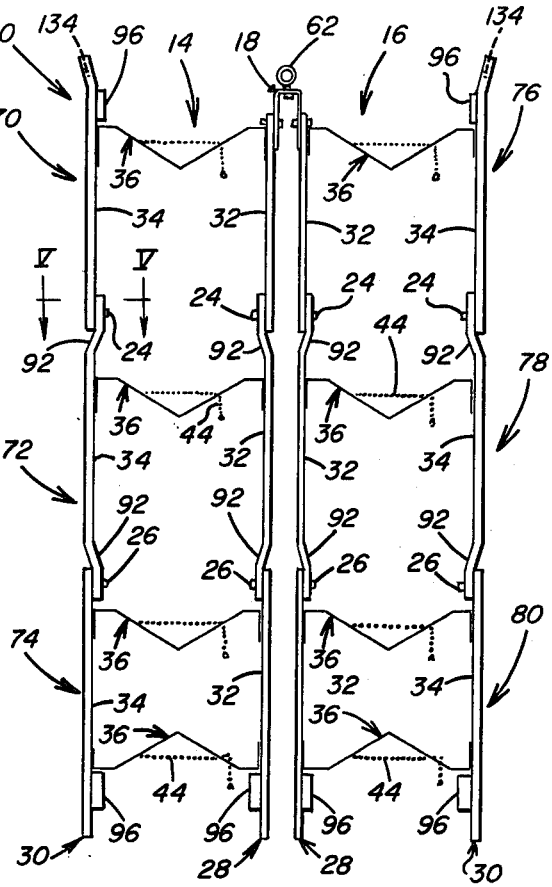
FIG. 2 is a front view in elevation of a garment display rack illustrating the pair of leg frame members that are pivotally constructed and adapted to receive the legs of a pair of trousers.
Figure 3:
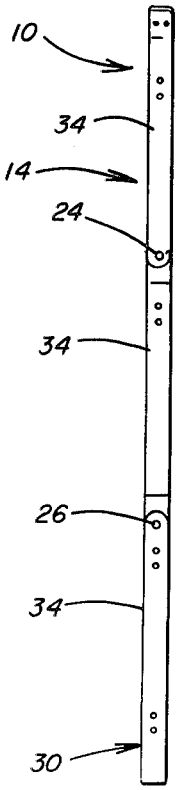
FIG. 3 is a view in side elevation of a garment display rack as shown in FIG. 2, illustrating the articulated connection of the elongated elements that form each of the pair of leg frame members.
Figure 4:
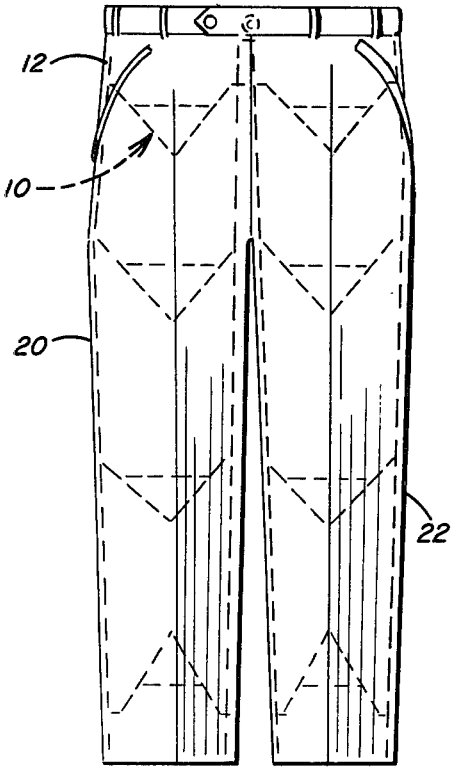
FIG. 4 is a schematic view of a pair of trousers positioned on the garment display rack of the present invention, illustrating the display rack in phantom.

Referring to the drawings and more particularly to FIGS. 1, 2, and 3 there is illustrated a display rack generally designated by the numeral 10 for displaying garments such as a pair of trousers 12 on the rack 10 which is illustrated in phantom in FIG. 4, in a manner to present the trousers in an imaginative arrangement to promote merchandising of the trousers in a display window or a store. The display rack 10 is formed by a pair of leg frame members 14 and 16 that are connected together at their upper end portions by a spring steel yoke member 18 in a manner to be explained later in greater detail. The leg frame members 14 and 16 are adapted to be inserted into the respective legs 20 and 22 of the trousers 12 as illustrated in FIG. 4. The leg frame members 14 and 16 are also capable of being articulated at a plurality of pivot points 24 and 26 along the length thereof. With this arrangement the leg frame members 14 and 16 may be independently angularly positioned relative to each other in the manner as illustrated in FIG. 6 to support a pair of trousers in an attractive and imaginative display as seen in FIG. 7.

Each of the pair of leg frame members 14 and 16 includes a trouser inner seam support generally designated by the numeral 28 and a trouser outer seam support generally designated by the numeral 30. With this arrangement as illustrated in FIG. 4 when the leg frame members 14 and 16 are inserted into the trouser legs 20 and 22 the trousers legs are stretched tautly between the inner and outer seam supports 28 and 30 so that both a complete frontal and rear view of the trousers is obtained as opposed to a front to rear view between the creases of the trouser legs. The inner and outer seam supports 28 and 30 are, in turn, formed by a plurality of elongated elements 32 and 34. The elements 32 and 34 can be fabricated from various selected material such as metal, wood, plastic, fiber glass, and the like. The elongated elements 32 are positioned in end to end relationship to form the inner seam support 28. Similarly the plurality of elongated members 34 are positioned in end to end relationship to form the outer seam support 30. This construction applies to both the leg frame members 14 and 16.

Figure 6:
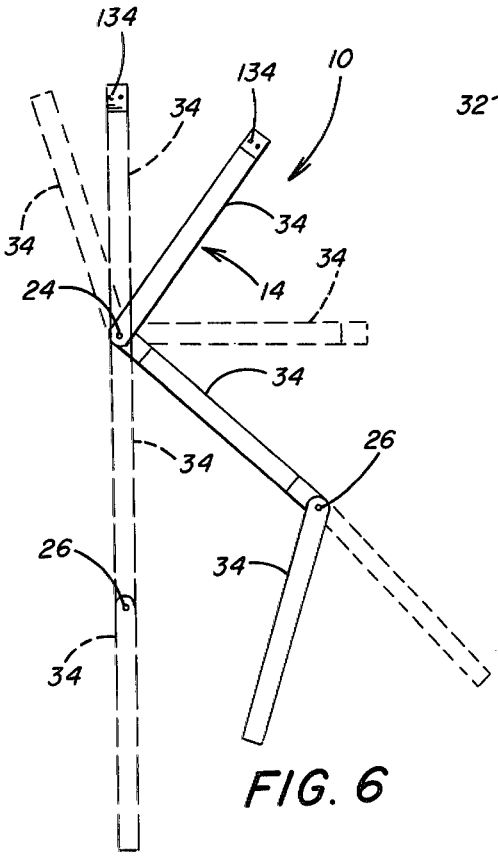
FIG. 6 is a schematic view illustrating the plurality of angular positions into which the elongated elements can be pivoted for arranging the display rack in a selected manner for displaying the garment positioned thereon.
Figure 7:
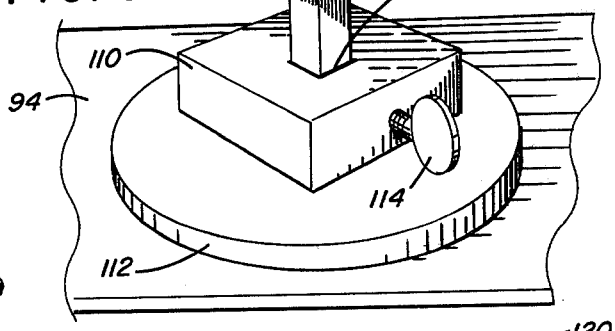
FIG. 7 is an isometric view illustrating a pair of trousers positioned on the display rack and arranged with the legs in relative angular positions with the rack mounted on a support that is clamped to a display shelf.
Figure 7:
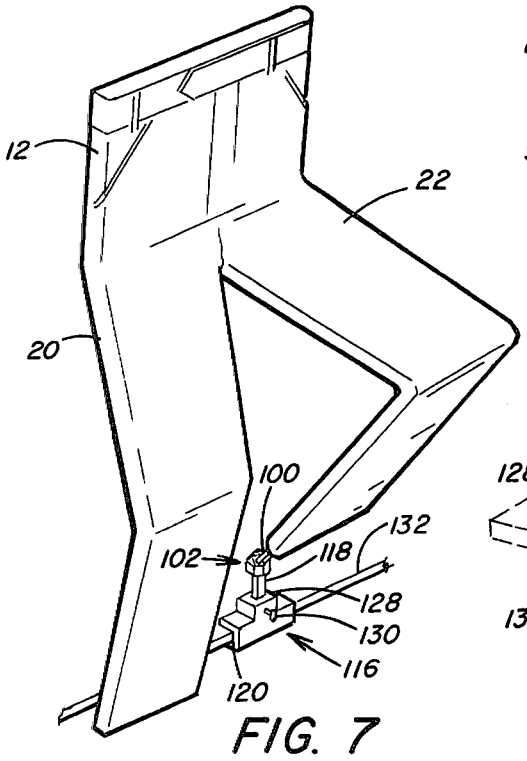

Preferably the leg frame members 14 and 16 are movable from a spaced parallel relationship as shown in FIG. 2 to a preselected articulated relationship shown in FIG. 6 and as shown in FIG. 7 with a pair of trousers positioned on the leg frame members 14 and 16. Also as illustrated in FIGS. 1 and 2 the elongated elements 32 and 34 are positioned in what may be considered a normal arrangement in spaced parallel relationship where pairs of elongated members 32 and 34 are positioned oppositely from one another and resiliently connected to each other by an adjustment device generally designated by the numeral 36.

With this arrangement each of the leg frame members 14 and 16 is formed by a plurality of pairs of elongated elements 32 and 34 that are pivotally connected in end to end relationship and are independently pivotal about the pivot points 24 and 26 to a preselected angular position. This permits the pair of leg frame members 14 and 16 to be pivoted at a plurality of points, namely the pivot points 24 and 26, along the length thereof.

Figure 8:
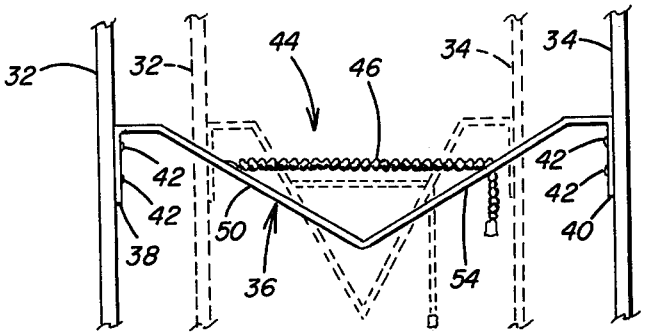
FIG. 8 is a fragmentary schematic view illustrating the spring steel members that connect pairs of the elongated elements and a catch for maintaining the elongated elements in a compressed position spaced a preselected distance apart.

In the preferred embodiment the adjustment devices 36 include a metal spring member, such as spring steel having, as illustrated in greater detail in FIG. 8, flanged end portions 38 and 40 that are suitably connected as by rivets 42 to the inner surfaces of each of the pairs of elongated elements 32 and 34 that form the leg frame members 14 and 16. The spring members 36 are V-shaped and bent intermediate the end portions to facilitate contraction and expansion of the length of the springs between the flanged end portions 38 and 40. As an alternative to the spring members 36, other adjustment devices can be used in accordance with the present invention, such as threaded members, pivotal levers, plungers, piston cylinder assemblies, coil springs, and the like.

The springs 36 normally force the elongated elements outwardly away from each other in the position indicated by the solid lines for the members 32 and 34 in FIG. 8. However, by applying inward compressive forces upon the elongated members 32 and 34 the length of the springs 36 is shortened so that the elongated elements 32 and 34 move closer together as shown by the dotted lines in FIG. 8. In this manner the inner and outer seam supports 28 and 30 formed by the elongated members 32 and 34 can be adjusted to facilitate ease of insertion of the leg frame members 14 and 16 into the trouser legs 20 and 22 and further to accommodate variations in widths of trouser legs. Once the springs 36 of each leg frame 14 and 16 are compressed to facilitate insertion in the trouser legs 20 and 22, release of the compressive forces on the elongated members 32 and 34 in the trouser legs 20 and 22 permits the springs 36 to extend to a length where the trouser legs 20 and 22 are stretched tauntly between the inner and outer seams of each trouser leg.

Further in accordance with the present invention a catch device generally designated by the numeral 44 in FIGS. 1, 2, 8, and 12 is provided on each of the adjustment devices 36 to maintain the devices 36 in a preselected compressed position. In this manner it is possible to maintain a selected width between the inner and outer seam supports 28 and 30 and also to adjust the width of each of the leg frame members 14 and 16 to accommodate slacks or trousers of different styles and sizes.

Figure 12:
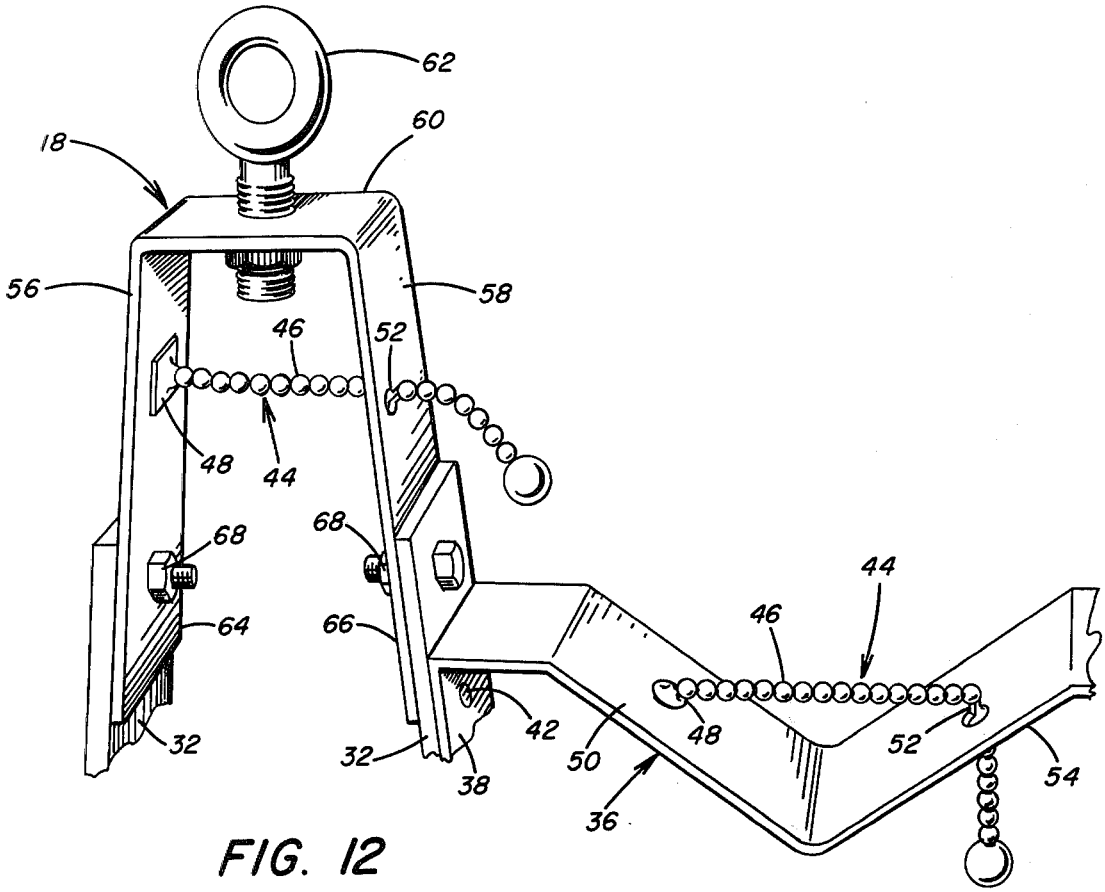
FIG. 12 is an enlarged fragmentary view of the spring-like yoke member that connects the respective leg frame members of the upper end portions thereof and the catch for maintaining the spring steel members under tension.

Referring to FIG. 12 a representative one of the catch devices 44 is illustrated in detail for maintaining the springs 36 in a preselected compressed position as determined by the desired width for the respective leg frame member. The catch device 44 includes a beaded chain 46 rigidly secured in a suitable manner at one end to a support 48 that is secured to an arm 50 of the spring 36. The opposite end of the beaded chain 46 extends in a horizontally positioned key hole slot 52 in an opposite arm 54 of the spring 36. The key hole slot 52 includes a restricted portion for catching the chain 46 and holding it under tension and an enlarged portion for facilitating free movement of the beaded chain through the slot 52.

Thus with this arrangement by drawing the beaded chain 46 through the key hole slot 52, the arms 50 and 54 are drawn together thereby compressing the spring 36. This draws the oppositely positioned elongated elements 32 and 34 together to, in turn, adjust the width of the respective leg frame member. When the desired width is achieved the chain is locked in position to mainain that width by sliding it into the restricted portion of the key hole slot 52 where it is maintained under tension.

As seen in FIGS. 1 and 2 each of the respective pairs of elongated elements 32 and 34 have at least one metal spring 36 secured to and extending therebetween. The pairs of elongated elements 32 and 34 may be provided with more than one spring 36. As for example, the lowermost pair of elongated elements 32 and 34 for the leg frame members 14 and 16 are provided with two springs 36 in which each spring 36 is provided with the above described catch device 44 for maintaining a preselected spacing between the pairs of elongated elements 32 and 34.

It is also possible to vary to a degree the width of each frame member 14 and 16 from the upper end portion where the frame members are connected by the yoke 18 to the lower end portion of each of the leg frame members 14 and 16. Thus, for trousers and slacks that vary in width from the waist portion to the bottom of the leg it is possible with the resilient springs 36 and the catch devices 44 to accommodate the variation in width. This provides a means for attractively displaying trousers or slacks of different styles and having legs of varying width along their length in a manner as they would actually be worn.

The catch device 44 is also adaptable as seen in FIG. 12 to maintain the connecting yoke 18 under a preselected degree of compression thereby controlling the spacing between the leg frame members 14 and 16. As for the arrangement of the catch devices 44 for each of the springs 36, the catch device 44 for the yoke 18 also includes a beaded chain 46 connected at one end to a support 48 that is suitably attached to an arm 56 of the yoke 18. The opposite end of the beaded chain 46 extends through a key hole slot 52 having as above described a restricted end and an enlarged end.

The key hole slot 52 extends through an opposite arm 56 of the yoke 18. The arms 56 and 58 are connected at their upper end portions by a cross bar 60 through which extends an eye bolt 62. Eye bolt 62 is adaptable to engage a support for suspending or hanging the display rack 10 as opposed to supporting the display rack on a floor as illustrated in FIG. 1. The yoke 18 is a resilient, compressible member constructed of a similar material as the spring devices 36, i.e. a spring metal material. This permits the yoke legs 56 and 58 to be movable toward and away from each other.

By drawing a selected length of the beaded chain 46 through the key hole slot 52, the arms 56 and 58 are drawn together and placed under tension to, in turn, draw together the leg frame members 14 and 16. The yoke member arms 56 and 58 are then maintained in the desired spaced relation by urging the beaded chain 46 into the restricted portion of the key hole slot 52. Each of the yoke arms 56 and 58 include end portions 64 and 66 that are secured by a nut and bolt combination 68 to the elongated elements 32 that form the uppermost portion of the inner seam suport 28 for each of the leg frame members 14 and 16. In this manner, the connecting yoke 18 is connected to the leg frame members 14 and 16.

As illustrated in FIG. 2, each of the leg frame members 14 and 16 is formed by a plurality of pairs of the elongated elements or members 32 and 34. A plurality of pairs 70, 72, and 74 of connected elongated members 32 and 34 form the leg frame member 14. Similarly a plurality of pairs 76, 78 and 80 of the elongated members 32 and 34 form the leg frame member 16. Each of the respective pairs 70–80 are connected by the resilient devices 36. The pair 70 is pivotally connected to the pair 72, and the pair 72 is pivotally connected to the pair 74 for leg frame member 14, similarly, the pair 76 is pivotally connected to the pair 78, and the pair 78 is pivotally connected to the pair 80 for the leg frame member 16. The pivotal connections are formed at pivot points 24 and 26 as above described.

Figure 5:
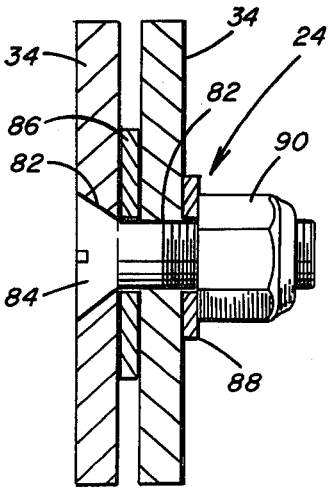
FIG. 5 is a sectional view taken along line V—V of FIG. 2, illustrating the articulated connection of the elongated elements.

Each of the pivot points 24 and 26 are constructed in the same manner. A representative pivot point 24 is illustrated in FIG. 5. The pivot point 24 illustrated in FIG. 5 corresponds to the pivot point 24 connecting the pair 70 with the pair 72 at their adjacent end portions. The adjacent end portions of the elongated elements 34 are positioned in overlapping relation. Each of the elongated elements 34 includes a bore 82 for receiving a threaded member 84 that extends through the aligned bores 82. The end portion of the threaded member 84 extends beyond the innermost elongated element 34.

Positioned between the elements 34 and on the shank of the threaded member 84 is a conventional lock washer 86. Also, positioned on the portion of the threaded member 84 that extends out of the bores 82 is a second washer 88. The first elongated element 34, the lock washer 86, the second elongated member 34 and the second washer 88 are maintained in abutting relation by a nut 90 that is threaded on to the extended end of the threaded member 84. The nut 90 is advanced into position to form a tight fit of the elongated elements 34 to each other but permit relative pivotal movement of the elongated elements 34 relative to each other about pivotal axis formed by the threaded member 84.

With this arrangement the elements 34 are free to pivot. When the elements 34 are pivoted to a selected angular position, the friction generated between the abutting parts on the threaded member 34 maintains the elements 34 in the preselected pivoted position. Thus once the elements have been moved it is not necessary to make any further adjustments by tightening the nut 90 on the threaded member 84 to maintain the selected angular position. The above arrangement is also applicable to the pivotal connection of the elongated elements 32.

The leg frame members 14 and 16 are freely pivotal at the pivot points 24 and 26 to a variety of angular positions as schematically illustrated in FIG. 6. The upper pair of elements 70 may extend at an angle relative to the intermediate pair of elements 72. Likewise the lower pair of elements 74 may be pivoted relative to the intermediate pair of elements 72. The pairs 70, 72, and 74 are shown in phantom in a vertically aligned position in FIG. 6, and the respective pairs are pivotal from this position as illustrated. This arrangement also is applicable to the pairs 76, 78, and 80. This pivotal arrangement of the leg frame members 14 and 16 provides a variety of imaginative and attractive positions in which a pair of trousers or slacks may be displayed on the rack 10.

Further in accordance with the present invention the inner and outer seam supports 28 and 30 form an outer planar surface as well as an inner planar surface that abuts the inner and outer seams of the trousers when positioned on the rack 10. Therefore in order to prevent snagging of the trousers by the respective elongated elements 32 and 34, the intermediate pairs 72 and 78 of the elongated elements for both leg frame members 14 and 16 are displaced at their end portions where they overlap the adjacent elongated elements. This maintains alignment of the elements at the inner and outer seams of the trousers. As illustrated in FIG. 2 the pair 72 and 78 of the elongated elements 32 and 34 have displaced end portions 92 that permit the elements to be positioned in underlying relationship with the adjacent elements. This configuration of the end portions 92 of the elements 32 and 34 forming the pairs 72 and 78 permits the outer surfaces of the leg frame members 14 and 16 to be maintained in planar alignment. By maintaining a planar alignment of the outer surfaces of the inner and outer seam supports 28 and 30 a neat and attractive appearance is presented when the trousers are positioned on the leg frames 14 and 16.

The display rack 10 is self supporting on a surface, such as a floor, where the leg frame members 14 and 16 are bendable to selected angles at the pivot points 24 and 26 to create an eye-catching display of trousers on the display rack 10. For example, the display rack 10 can be bent to create a sitting, reclining, kneeling or any other display position. As illustrated in FIG. 1 the display rack 10 also may be supported on a stand generally designated by the numeral 94. To accommodate the connection of the display rack to the stand 94 each of the elongated elements 32 and 34 that form the upper and lower ends of the respective leg members 14 and 16 are provided with sleeves 96 that are suitably secured as by riveting to the inner surface of the respective elongated elements 32 and 34 at the ends thereof. The sleeves 96 form with the respective elongated elements a channel 98 for receiving a brace member such as bar 100 that extends upwardly from the stand 94. The bar 100 may be suitably connected directly to the stand 94, or in a manner as illustrated in FIG. 1 may be connected to a support block generally designated by the numeral 102 in FIG. 1 and illustrated in greater detail in FIG. 9.

Figure 9:
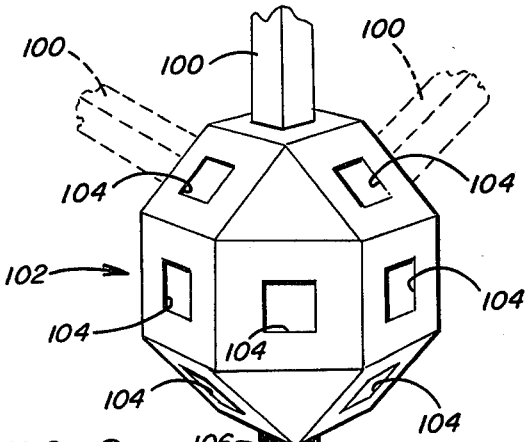
FIG. 9 is a fragmentary schematic view of a multisocketed block adapted to support one or more display racks in selected angular positions from a stand.

The block 102 is a multi-faced three dimensional structure having a plurality of sockets or recesses in each of the faces. As seen in FIG. 9 a number of the faces are positioned at an angle relative to the other faces thereby permitting an adjustment in the angle from which the bar 100 is secured to and extends from the block 102 and in turn the stand 94.

The block 102 may have any number of planar faces positioned at various angles. The lower planar surface of the block 102 also is provided with a socket into which is extended a second bar 106 similar to the bar 100. The opposite end of the bar 106 extends into a socket 108 that is provided in a base 110 which, in turn, is suitably supported on a pedestal 112 that is formed integral with the stand 94. The base 110 includes a thumb set screw 114 that extends through the base 110 and into the socket 108. The thumb set screw 114 is advanced through the base and into the socket 108 to engage and firmly secure the bar 106 to the base 110.

The display rack 10 may be connected to the base 94 by extending the bar 100 into any one of the sleeves 96 that extend from the elongated elements 32 and 34 at the upper and lower ends of each frame member 14 and 16. Thus, with this arrangement, the display rack can be connected through the multi-faced block 102 to the stand 94 to support the rack 10 in the position illustrated in FIG. 1. Any one of the lower support elements may be connected to the rod 100. Further, the display rack 10 may be connected to the base 94 or some other support structure as will be described later in greater detail in an inverted position where the connecting member 18 would be positioned adjacent the stand 94.

Figure 10:
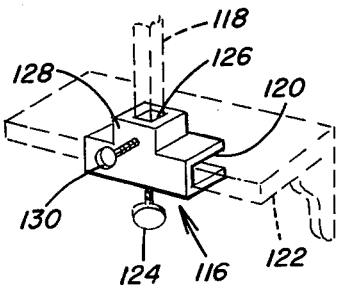
FIG. 10 is a schematic view illustration a clamp that is removably engagable with a shelf for supporting the display rack on the shelf.
Figure 11:
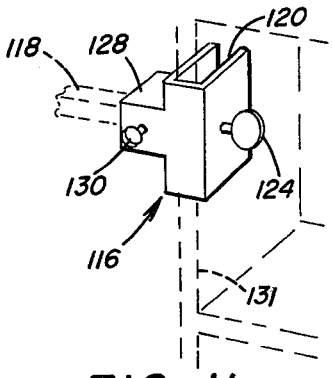
FIG. 11 is a schematic view similar to FIG. 10 illustrating another alternative arrangement for supporting the display rack from a vertical member of a shelf by the clamp.

An alternative to mounting the display rack 10 to a supporting structure is illustrated in FIGS. 10 and 11 where a bracket or clamp generally designated by the numeral 116 is secured to a suitable supporting structure. A rod 118 extends from the clamp 116 and is secured at its opposite end within a channel 98 of one of the sleeves 96 positioned at either end of the display rack 10. This provides further variations in the manner in which a garment may be displayed on the rack 10.

As illustrated in FIG. 10, the clamp 116 is provided with a U-shaped recess 120 that is positioned on a supporting structure, as for example a shelf 122. A thumb screw 124 extends into the recess 120 to engage the shelf 122 and secure the clamp 116 in place. The supporting bar 118 extends downwardly into a socket 126 in a pedestal portion 128 of the clamp 116. The bar 118 is retained in the socket 126 by a set screw 130. As illustrated in FIG. 10, the recess 120 is positioned in a horizontal plane so that the bar 118 that supports the display rack 10 extends vertically to vertically support the display rack 10.

In a further alternative arrangement for supporting the display rack 10 to a structure by the clamp 116, as illustrated in FIG. 11, the recess 120 is positioned on a vertical member 131 that forms part of a shelf complex shown in phantom. With this arrangement the recess 120 is retained in a vertical position on the member 131 so that the support bar 118 extends outwardly in a horizontal direction. With the bar 118 extending in a horizontal direction, the rack 10 connected to the bar 118 is supported in a horizontal position. Thus, the clamp device 116 illustrated in FIGS. 10 and 11 is adapted for mounting in a variety of positions for imaginatively supporting the display rack 10.

Further in accordance with the present invention, as illustrated in FIG. 7, the features of the support clamp 116 and the multi-faced block 102 can be combined to further support a pair of trousers 12 in an attractive and imaginative manner on the display rack 10. With this arrangement, the clamp 116 is secured with the recess 120 in a horizontal position on a shelf or a support ledge 132. The bar 118 is secured to and extends upwardly from the pedestal portion 128. Mounted on the opposite end of the bar 118 is the multi-faced block 102. The bar 100 is positioned in one of the sockets 104 of the block 102. The bar 100 is connected to one of the leg frame members 14 or 16 as above described. The bar 100 may extend from one of the socket faces which is displaced at an angle from the vertical. Also, as shown in FIG. 7, the pair of trousers 12 are supported by the display rack 10 width the frame members 14 and 16 pivoted to a selected angular position to, in turn, present an action-type display.

Figure 13:
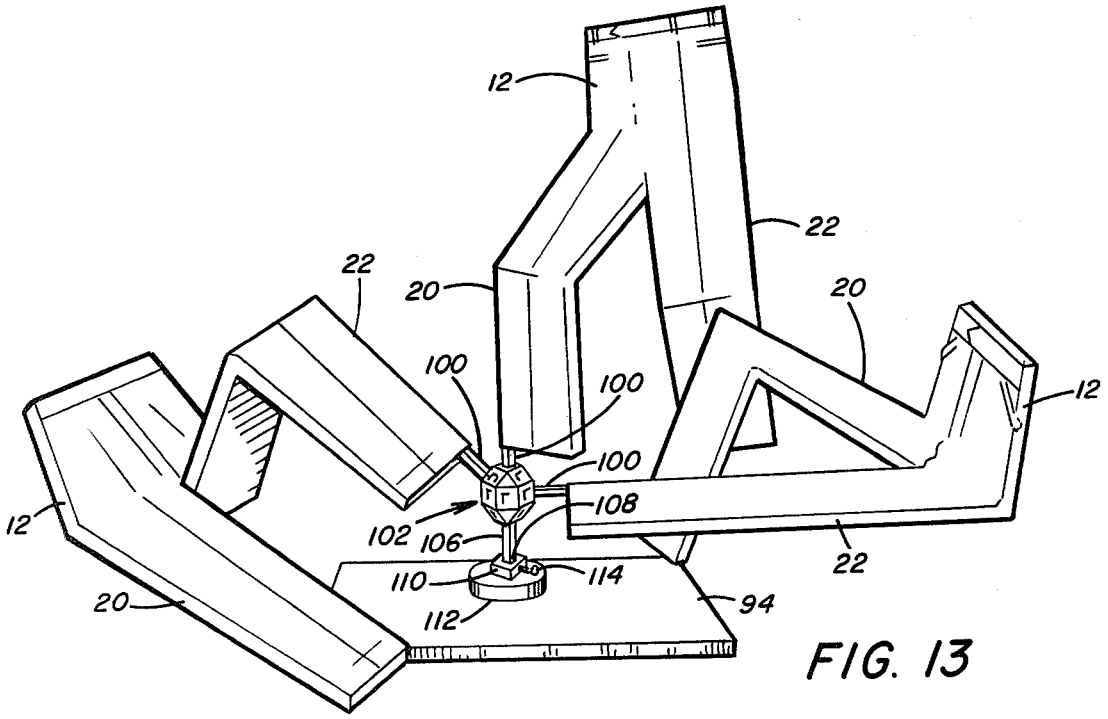
FIG. 13 is a schematic view of a display of trousers supported by a plurality of display racks of the present invention, illustrating each of the display racks connected by the multi-socketed block to a supporting base.

Further, in accordance with the present invention, a further alternative arrangement for supporting the display rack 10 on a stand 94 is illustrated in FIG. 13. In this arrangement, the multi-faced block 102 is utilized as a common support to support a plurality of display racks 10 in various angular positions with each of the display racks arranged in selected angular positions. This presents an attractive, imaginative display for merchandising trousers in an array that permits a number of display racks 10 to be used simultaneously and in various combinations with one another to achieve a dynamic visual effect.

As illustrated in FIGS. 1 and 2, the display rack 10 may also include at the upper end portions of the outer elongated elements 34 a pair of apertures 134. The apertures 134 may be utilized to attach an auxiliary display aid to the rack 10 and thereby achieve further eye-catching and visual effects to bring attention to the garment being displayed on the rack 10. In addition, the apertures 134 can be used to hang the display rack from an overhead structure in a manner similar to supporting the rack 10 from an overhead structure by the eye bolt 62. Further, with regard to the upper end portions of the elongated elements 34 at the top of the display rack 10, the end portions are canted outwardly. This feature is provided to assure engagement of the waist portion of a pair of trousers to the upper end of the display rack 10 and to maintain the waist portion taut and secure on the rack 10.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A garment display rack comprising, a frame member for supporting and displaying a garment, said frame member including an inner seam support and an outer seam support, adjustment means secured to and extending between said inner and outer seam supports for maintaining said inner and outer seam supports in spaced relation, said adjustment means being expandable and contractable in length between said inner and outer seam supports to permit movement of said inner and outer seam supports toward and away from each other to adjust the width of said frame member, each of said inner and outer seam supports including a plurality of elongated elements positioned in end to end relationship, and pivot means for connecting adjacent ends of said elongated elements to form for said inner and outer seam supports at least a pair of said elongated elements being independently pivotal to a preselected angular position so that said frame member is pivotal at a preselected pivot point along the length thereof.

2. A grament display rack as set forth in claim 1 which includes, means for maintaining said adjustment means in a preselected position to space said inner and outer seam supports a preselected distance apart.

3. A garment display rack as set forth in claim 2 in which, said adjustment means includes a compressible member connected to said inner and outer seam supports for normally urging said inner and outer seam supports away from each other, a catch device releasably secured to said compressible member, and said catch device being operable to maintain said compressible member in a preselected position between a compressed position and an extended position to space said elongated elements of each of said pair of elongated elements a preselected distance apart.

4. A garment display rack as set forth in claim 1 which includes, a stand for supporting said frame member, a mounting means connected to said stand for positioning said frame member in a preselected angular position relative to said stand, and said mounting means being releasably engageable with a selected one of said elongated elements.

5. A garment display rack as set forth in claim 1 which includes, a sleeve connected to a selected one of said elongated elements at a selected end of said frame member, said sleeve having a channel, and mounting means for supporting said frame member by engagement with said channel to position said frame member in a preselected position.

6. A garment display rack as set forth in claim 1 which includes, a support block, means for rigidly supporting said support block, said support block having a plurality of sockets arranged at a plurality of angular positions in a plurality of planes, a bar secured at one end portion to a selected one of said elongated elements, said bar positioned at a second end portion in one of said plurality of sockets of said support block, and said bar extending at a preselected angle from said support block to support said frame member at a preselected angle.

7. A garment display rack as set forth in claim 1 which includes, a pair of said frame members positioned in spaced, lateral relation a resilient member connecting said pair of frame members to permit relative movement between said pair of frame members, and said resilient member being expandable and contractable to facilitate movement of said pair of frame members to move toward and away from each other and allow adjustments in the spacing between said pair of frame members.

8. A garment display rack as set forth in claim 1 in which, said adjustment means includes a plurality of spring members secured to and extending between said plurality of spaced pairs of said elongated elements, said spring members being compressible and operable to normally urge said pairs of said elongated elements outwardly in spaced relation, and said pairs of said elongated elements being movable by compression and expansion of said spring members a preselected distance apart to thereby permit adjustments in the width of said frame member.

9. A garment rack as set forth in claim 8 which includes, a catch device secured to and extending between the opposite ends of each of said spring members for exerting a compressive force upon said respective spring member and move said respective pair of elongated elements into a preselected spaced relationship.

10. A garment display rack as set forth in claim 1 in which, said pivot means includes a pivotal axis extending through adjacent ends of said elongated elements positioned in overlapping relation, lock means mounted on said pivotal axis for securing said adjacent ends of said elongated elements in a preselected angular relation, and means for maintaining said lock means in abutting relation with said elongated elements to permit said elongated elements to pivot on said pin member and be maintained in a preselected angular position.

11. Garment display apparatus comprising, a plurality of display racks, each of said display racks being formed by a pair of frame members, connecting means for connecting said pair of frame members in side by side relationship, each of said frame members including a plurality of pairs of elongated elements positioned in end to end relationship, said elongated elements of each of said pairs of elongated elements being connected in spaced relationship, means for pivotally connecting said pairs of elongated elements in end to end relationship so that each of said frame members is pivotal at a plurality of pivot points along the length thereof, a common support for said plurality of display racks, and said common support having means for positioning each of display racks at a preselected angle to thereby arrange said display racks in an array for displaying a garment on said display racks.

12. Garment display apparatus as set forth in claim 11 which includes, a plurality of rigid members extending at preselected angles from said common support, and said rigid members being connected to said respective display racks to securely support said display racks positioned in angular relation to each other.

13. Garment display apparatus as set forth in claim 11 in which, said common support includes a block member having a plurality of sockets arranged at a plurality of angular positions in a plurality of planes, and a plurality of rigid members extending at one end from said sockets at a preselected angle and connected at the opposite end to said respective display racks to support said display racks from said block member.

* * * * *